US008298124B2

(12) United States Patent
Brenner et al.

(10) Patent No.: US 8,298,124 B2
(45) Date of Patent: Oct. 30, 2012

(54) STRIKE TARGETS FOR TRAINING STAND

(75) Inventors: Patricia Brenner, Encino, CA (US); Greg Snyder, San Rafael, CA (US)

(73) Assignee: Hico Inc., Encino, CA (US)

( * ) Notice: Subject to any disclaimer, the term of this patent is extended or adjusted under 35 U.S.C. 154(b) by 0 days.

(21) Appl. No.: 13/185,317

(22) Filed: Jul. 18, 2011

(65) Prior Publication Data

US 2011/0275492 A1 Nov. 10, 2011

Related U.S. Application Data

(63) Continuation of application No. 12/235,262, filed on Sep. 22, 2008, now Pat. No. 7,981,009.

(60) Provisional application No. 60/975,984, filed on Sep. 28, 2007.

(51) Int. Cl.
*A63B 21/00* (2006.01)

(52) U.S. Cl. ..... 482/83; 482/90

(58) Field of Classification Search ..... 482/83, 482/87, 90

See application file for complete search history.

(56) References Cited

U.S. PATENT DOCUMENTS

2002/0193211 A1* 12/2002 Kao ..... 482/83
2007/0197348 A1* 8/2007 Ku ..... 482/83
2009/0247374 A1* 10/2009 Chen ..... 482/89

* cited by examiner

*Primary Examiner* — Jerome w Donnelly
(74) *Attorney, Agent, or Firm* — Julio M. Loza; Loza & Loza, LLP

(57) ABSTRACT

A head-shaped target for a training stand is provided. The head-shaped target includes (a) a striking target body shaped to approximate a human head and operative to receive strikes, the striking target body having a padded surface; (b) an attachment member configured to releasably couple the head-shaped target to a support shaft of the training stand; and/or (c) an angled extension attachment coupling the striking target body to the attachment member, the angled extension attachment having a resilient spring positioned at an angle relative to the support shaft and the striking target body to enable the angled extension attachment to provide a resiliently deformable engagement between the striking target body and the support shaft.

20 Claims, 15 Drawing Sheets

STRIKE TARGETS FOR TRAINING STAND

PRIORITY CLAIM

This application claims the benefit of, and is a continuation application of, U.S. Ser. No. 12/235,262, filed Sep. 22, 2008, and entitled Collapsible Training Stand, which claims priority to U.S. Provisional Application Ser. No. 60/975,984 filed Sep. 28, 2007.

FIELD

Various features pertain to stands used for self-defense training, in particular to portable devices for practicing punching and kicking offensive and defensive techniques by hitting various pads or targets.

BACKGROUND

In the realm of exercise equipment, punching and/or kicking bags and targets are commonplace. Existing stands are designed to withstand punching and kicks and as a result tend to be bulky and/or permanent fixtures. As such, existing stands are not easy to move to different locations and are not easy to store away when not in use.

Additionally, users tend to be of different heights and have different exercise needs (e.g., punching versus kicking exercises, martial arts versus boxing, etc.). However, many existing punching and kicking exercise equipment are not easily adjustable to accommodate these needs.

One type of prior art portable exercise device for training self defense includes a large hollow base that is filled with water or sand to make it stable when kicking or punching the pads or targets. Such devices are typically very heavy after filled with water and sand and as a result they are difficult to store or move from one location to another.

Another type of prior art portable exercise device for training self-defense includes a human torso and head shape for practicing punching or kicking techniques. Such devices are not adjustable in the height or position of the head and torso, and as a result may not be appropriately sized for very tall or short people, or practicing techniques for a variety of human sizes.

Consequently, a portable stand for training self defense is needed that is stable, easily stored, moved around and easily adjustable over a range of heights and positions.

SUMMARY OF THE INVENTION

In a first example, a head-shaped target for a training stand is provided comprising: (a) a striking target body shaped to approximate a human head and operative to receive strikes, the striking target body having a padded surface; (b) an attachment member configured to releasably couple the head-shaped target to a support shaft of the training stand; and/or (c) an angled extension attachment coupling the striking target body to the attachment member, the angled extension attachment having a resilient spring positioned at an angle relative to the support shaft and the striking target body to enable the angled extension attachment to provide a resiliently deformable engagement between the striking target body and the support shaft. The angled extension attachment couples at a rear and base of the striking target body to provide improved range of motion when the striking target body is struck. The angle may be between 45 and 135 degrees. The attachment member may comprise a first quick release clamp that releasably couples the attachment member to the support shaft. The attachment member may further comprise a second quick release clamp that releasably couples the attachment member to the angled extension attachment. The angled extension attachment may be substantially permanently fixed to the striking target body and the attachment member. The padded surface of the striking target body substantially covers a top surface, a bottom surface, a front surface, a left side surface, and a right side surface of the striking target body. The bottom surface of the striking target body may be shaped and positioned to approximate a human chin, wherein the bottom surface is operative to receive uppercut punches and kicks.

In a second example, a torso-shaped target for a training stand is provided comprising: (a) a striking target body shaped to approximate a human torso and operative to receive strikes, the striking target body having a padded surface, wherein the striking body includes an angled bottom portion and angled bottom corners; (b) an attachment member configured to releasably couple the torso-shaped target to a support shaft of the training stand; and/or (c) an angled extension attachment coupling the striking target body to the attachment member, the angled extension attachment having a resilient spring positioned at an angle relative to the support shaft and the striking target body to enable the angled extension attachment to provide a resiliently deformable engagement between the striking target body and the support shaft. The angled extension attachment may couple at a rear and base of the striking target body to provide improved range of motion when the striking target body is struck. The angle may be between 45 and 135 degrees. The attachment member may comprise a first quick release clamp that releasably couples the attachment member to the support shaft. The attachment member may further comprise a second quick release clamp that releasably couples the attachment member to the angled extension attachment. The angled extension attachment may be substantially permanently fixed to the striking target body and the attachment member. The padded surface of the striking target body substantially covers a top surface, a front surface, a left side surface, a right side surface, the angled bottom portion, and the angled bottom corners of the striking target body. The angled bottom portion and the angled bottom corners of the striking target body may be shaped and positioned to approximate a portion of a human torso below the ribs, the angled bottom portion and the angled bottom corners configured to guide a user to use correct striking form.

In a third example, a hand-shaped target for a training stand is provided comprising: (a) a striking target body shaped and positioned to approximate a hand of a human and operative to receive strikes, the striking target body having a padded surface; (b) an attachment member configured to releasably couple the hand-shaped target to a T-bar support shaft of the training stand; and/or (c) an angled extension attachment coupling the striking target body to the attachment member, the angled extension attachment having a resilient spring positioned at an angle relative to the support shaft and the striking target body to enable the angled extension attachment to provide a resiliently deformable engagement between the striking target body and the T-bar support shaft. The angled extension attachment couples at a rear of the striking target body to provide improved range of motion when the striking target body is struck. The angle may be between 45 and 135 degrees. The attachment member may comprise a first quick release clamp that releasably couples the attachment member to the T-bar support shaft.

DETAILED DESCRIPTION OF THE INVENTION

In the following detailed description of the invention, numerous specific details are set forth in order to provide a thorough understanding of the invention. However, the invention may be practiced without these specific details. In other instances well known methods, procedures, and/or components have not been described in detail so as not to unnecessarily obscure aspects of the invention.

One aspect of the present invention provides a training device for hitting and kicking exercises, where the device comprises a training stand and a plurality of horizontally adjustable and vertically adjustable targets (e.g., punching/kicking targets).

The training stand may be collapsible for storage. For example, the collapsible training stand may comprise square tubing that is connected with a variety of linkages that allow the training stand to be locked rigidly with a vertical square tube held securely in place. The training stand can easily be unlocked and folded down to a compact set of tubes that are easy to store.

Conventional training stands are either bolted to a wall or floor for permanent installation or have bulky hollow bases that must be filled with water or sand to keep them from moving. As a result they are not easily moved or stored. By contrast, the portable training stand according to embodiments of the invention may be set up quickly and may quickly collapse for easy moving or storage.

Figure 14:
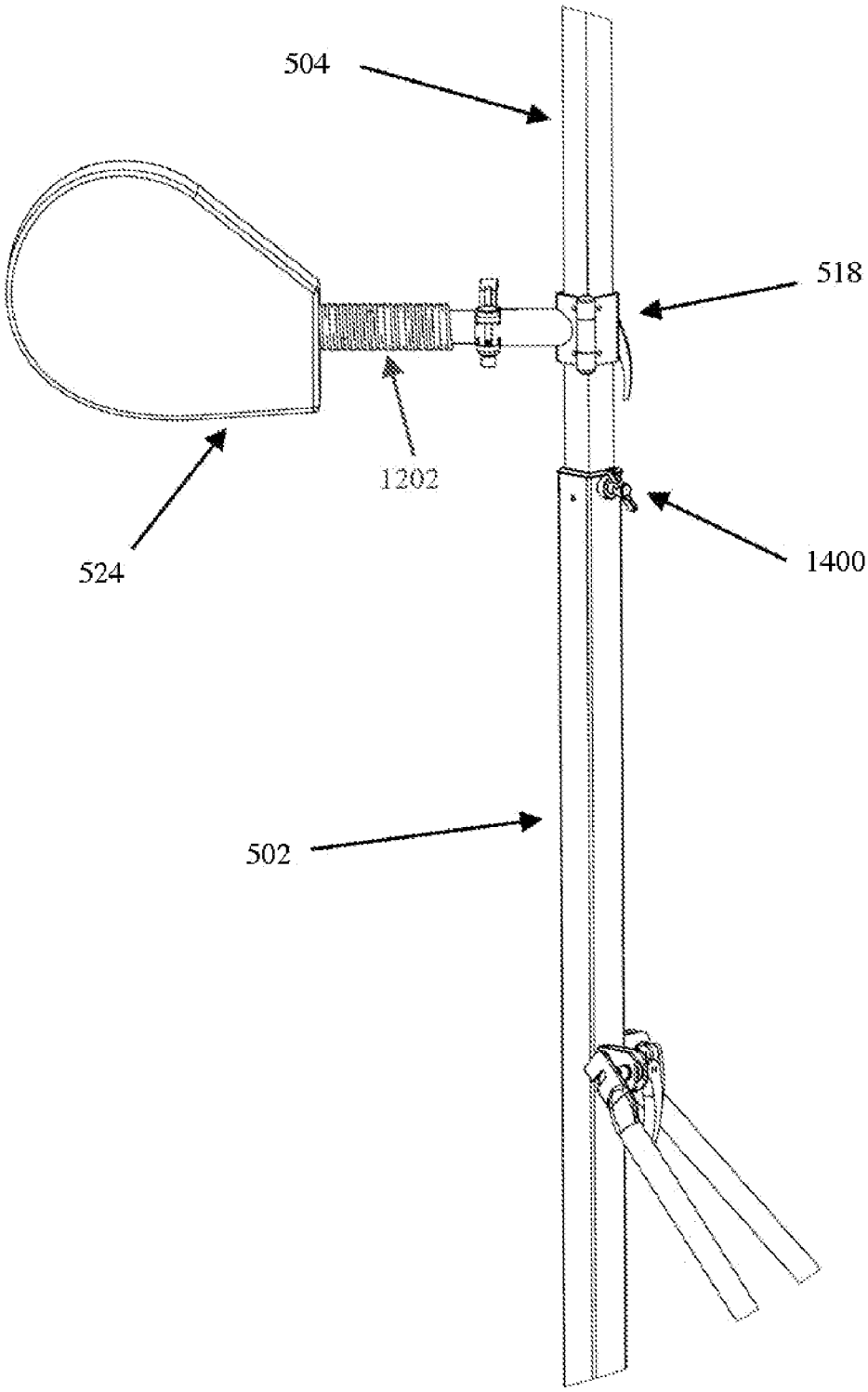
FIG. 14 illustrates a close-up view of at least one target positioned on the training stand of FIG. 9.

FIGS. 1 through 6 illustrate the training stand 100 in its upright and usable configuration from different perspectives. The training stand 100 includes a central frame member, i.e., a central support shaft 502 having one or more telescoping pieces 504 that can allow for adjusting the height of the stand. That is, the one or more telescoping pieces 504 can be extended or retracted to a desired height for exercising or mounting striking/kicking pads or targets. A locking mechanism 1400 (shown in FIG. 14), such as a pin, screw, or clamp, may serve to lock the one or more telescoping pieces 504 at a particular height. The training stand 100 may be adjustable in height by having a locking clamp 1400 that allows the telescoping pieces 504 to extend or retract from the central support shaft 502.

Additionally, a base operatively coupled to the central support shaft 502 includes folding legs 506 and 508 which may be pivotally coupled to one end of the central support shaft 502. Side linkages 512 and 514 serve to couple the central support shaft 502 and legs 506 and 508 in a fixed position. In the preferred configuration, a first end of the linkages 512 and 514 may be pivotally coupled to the legs 506 and 508 and a second end of the linkages hook onto brackets and clamp into place using a quick release clamp 516. When the side linkages 512 and 514 are locked into place on the central support shaft 502, the legs 506 and 508 are maintained substantially perpendicular to the central support shaft 502. When the side linkages 512 and 514 are unclamped from the central support shaft 502, they may be pivotally rotated around their connections with the folding legs 506 and 508 to collapse the training stand for storage. Alternatively, the side linkages 512 and 514 may be locked into place on the central support shaft 502 using pins, screws or any equivalent thereof.

In another example, the second end of the linkages 512 and 514 may be pivotally attached to a collar that slides on the central support shaft 502. The sliding collar may be locked into position on the central support shaft 502 to maintain the legs 506 and 508 substantially perpendicular to the central support shaft 502. The sliding collar may use a pin, a clamp, a screw or an equivalent mechanism to lock it into position.

Figure 8:
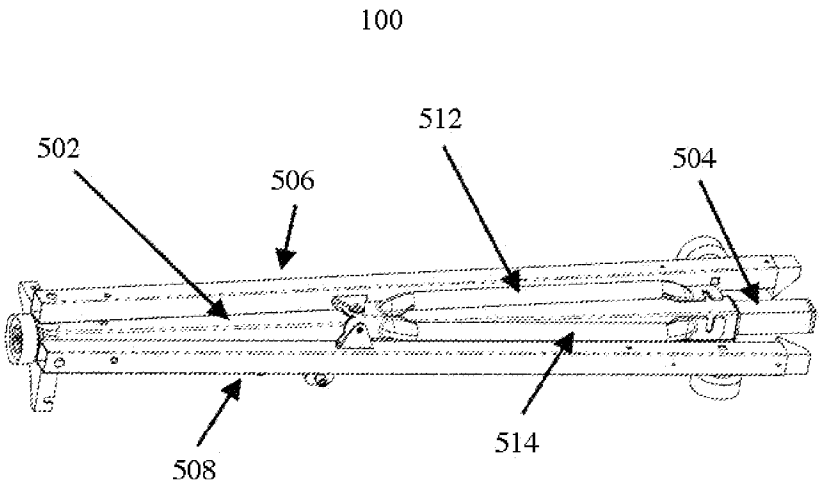
FIG. 8 illustrates a perspective view of the training stand of FIG. 1 in a collapsed state with no attachments thereon.
Figure 7:
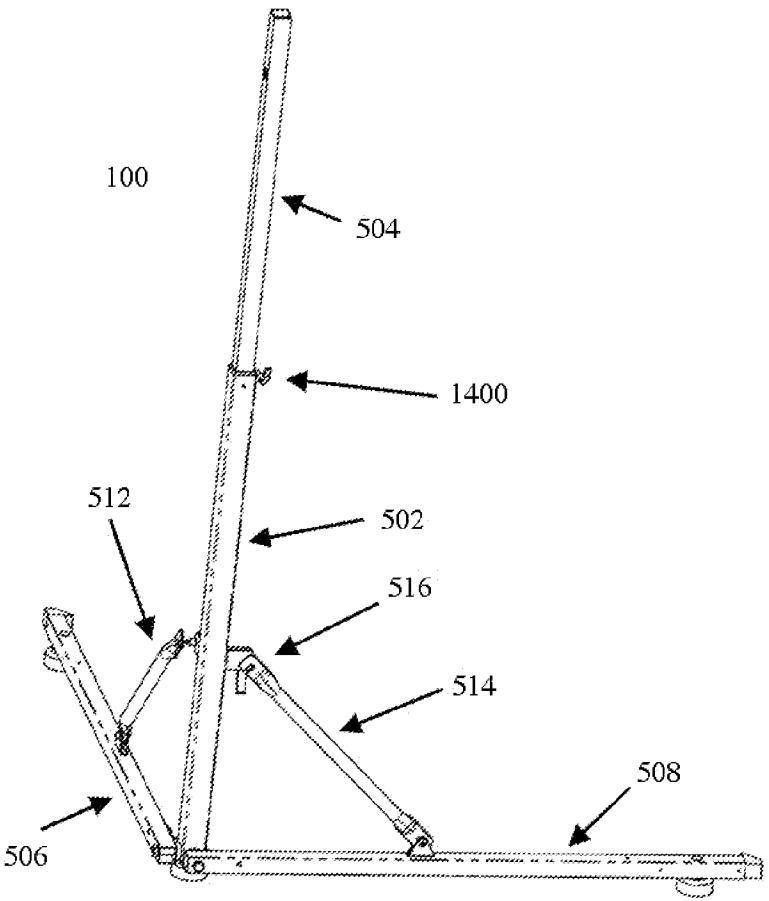
FIG. 7 illustrates a perspective view of the training stand of FIG. 1 in an expanded state with no attachments thereon.

FIG. 7 shows the training stand 100 in an upright and fully extended position with all the training pads, targets and other attachments removed. FIG. 8 shows the training stand 100 in its collapsed configuration for storage. As illustrated, the legs 506 and 508 may be folded against the central support shaft 502 while the telescoping pieces 504 may be retracted into the central support shaft 502.

The stand 100 may have square tubing or it might have some other tubing shape such as round or rectangular, for example. Additionally, the length of the folding legs 506 and 508 of the support stand 100 may be selected to provide stability to the stand 100 when it is used for punching or kicking training.

Figure 5:
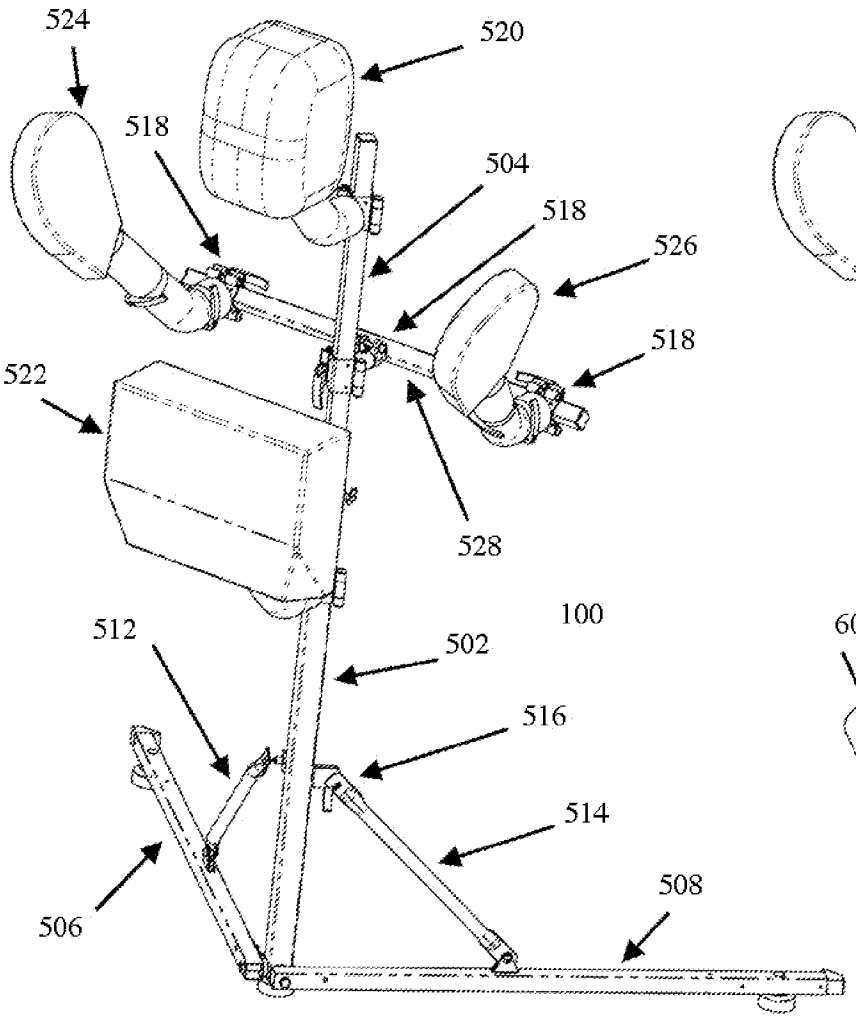
FIG. 5 illustrates a perspective view of the training stand of FIG. 1.
Figure 15:
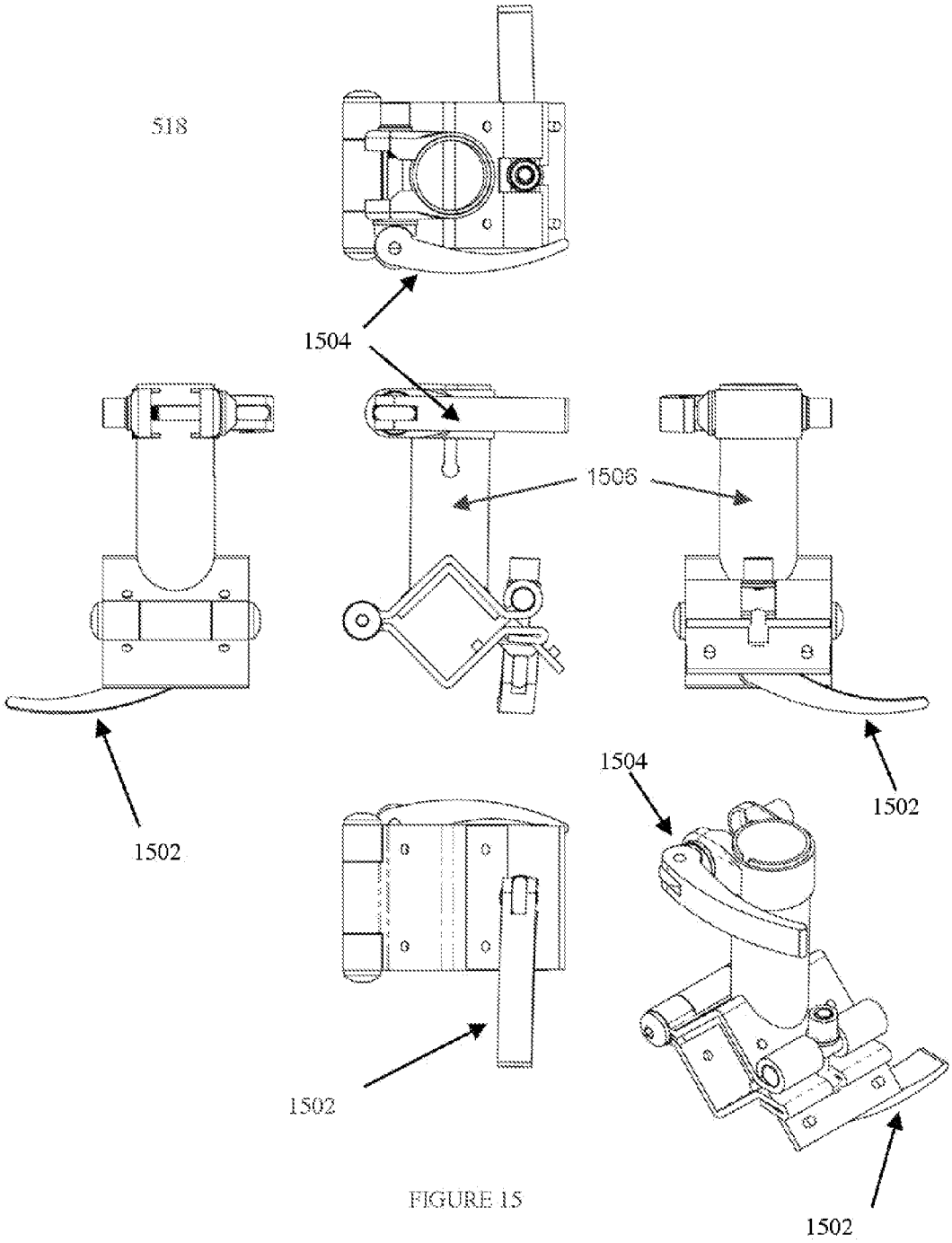
FIG. 15 illustrates various views of an embodiment of a connector which may be used in conjunction with the training stand of FIG. 1 and FIG. 9.

One advantage of this training device is that each pad, target and connector is easily removed from the stand 100 for storage through the use of quick release connectors or other easy to actuate clamping or pin mechanisms. The training stand 100 may include a plurality of connectors for attaching different training pads and targets. FIG. 5 shows a connector 518 (i.e., attachment member) on several locations on the training stand 100, i.e., on three (3) different locations on a T-Bar support 528. An example of a connector 518 that may be used is shown in FIG. 15. In one embodiment, T-Bar support 528 may be rotatable three hundred and sixty (360) degrees about the tube 1506 in the connector 518.

Figure 16:
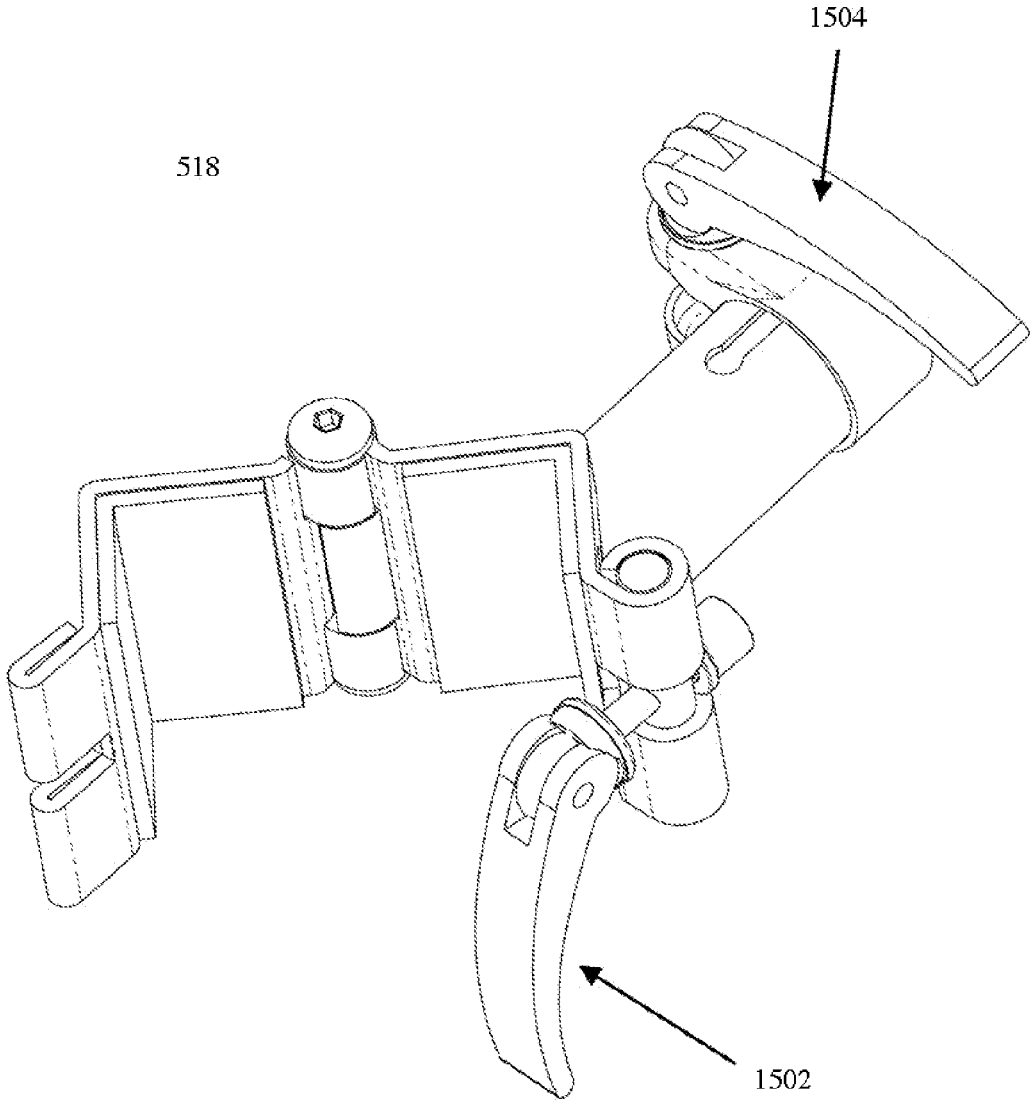
FIG. 16 illustrates a close-up view of the connector of FIG. 15.

FIG. 15 shows several views of the connector 518 in its closed configuration. FIG. 16 shows the connector 518 in its open configuration. Each of the connectors 518 may be attached anywhere along the length of the central support shaft 502 and telescoping piece 504 and locked rigidly thereto. Additionally, each of the connectors 518 may be attached anywhere along the length of the T-Bar support 528. The use of quick release clamps 1502 to attach the connectors 518 to the stand allow for easy attachment, easy removal and easy adjustability along the central support shaft 502 and the telescoping piece 504. The use of quick release clamps 1504 also allow for easy attachment, easy removal and easy adjustability of different training pads and targets without removing the connector from the central support shaft 502 or the telescoping piece 504.

Figure 6:
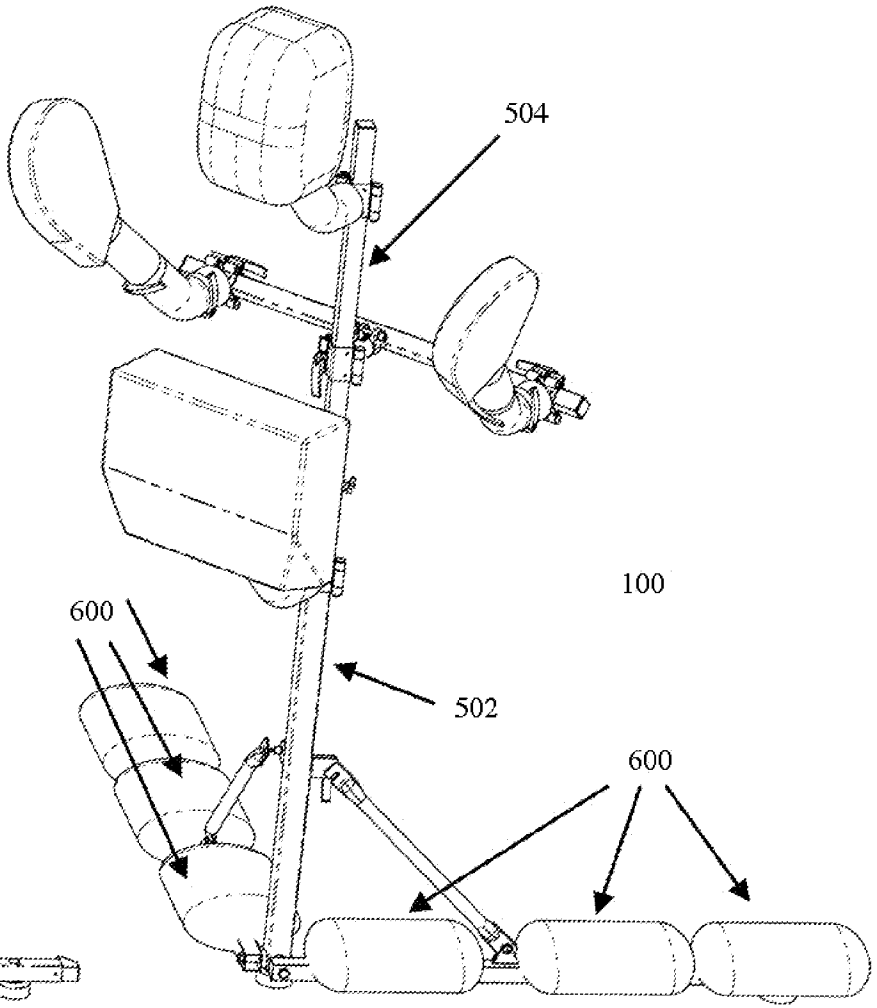
FIG. 6 illustrates a perspective view of the training stand of FIG. 1 with weight bags thereon.
Figure 18:
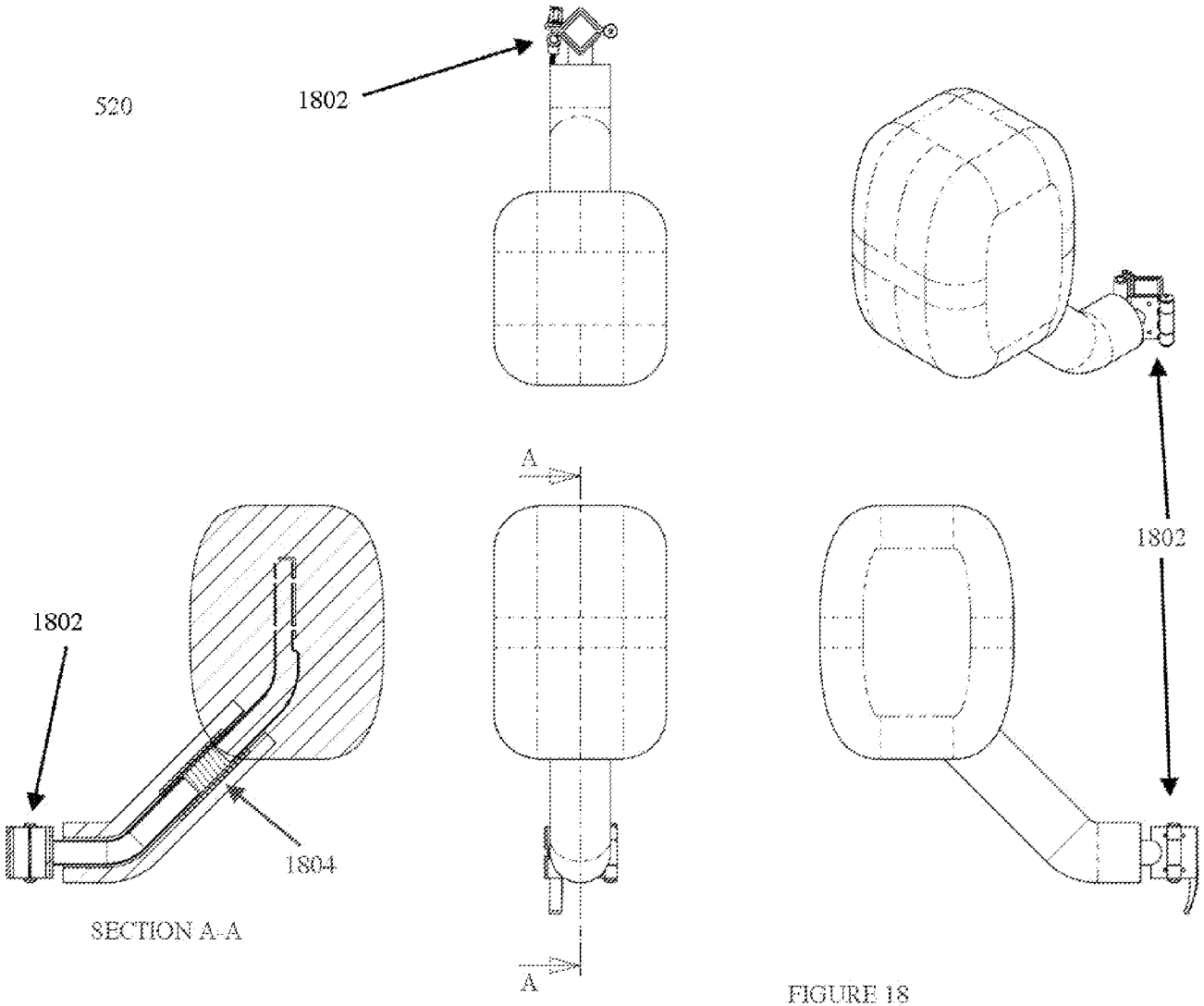
FIG. 18 illustrates various views of an embodiment of a head target which may be positioned on the training stand of FIG. 1 or FIG. 9.
Figure 19:
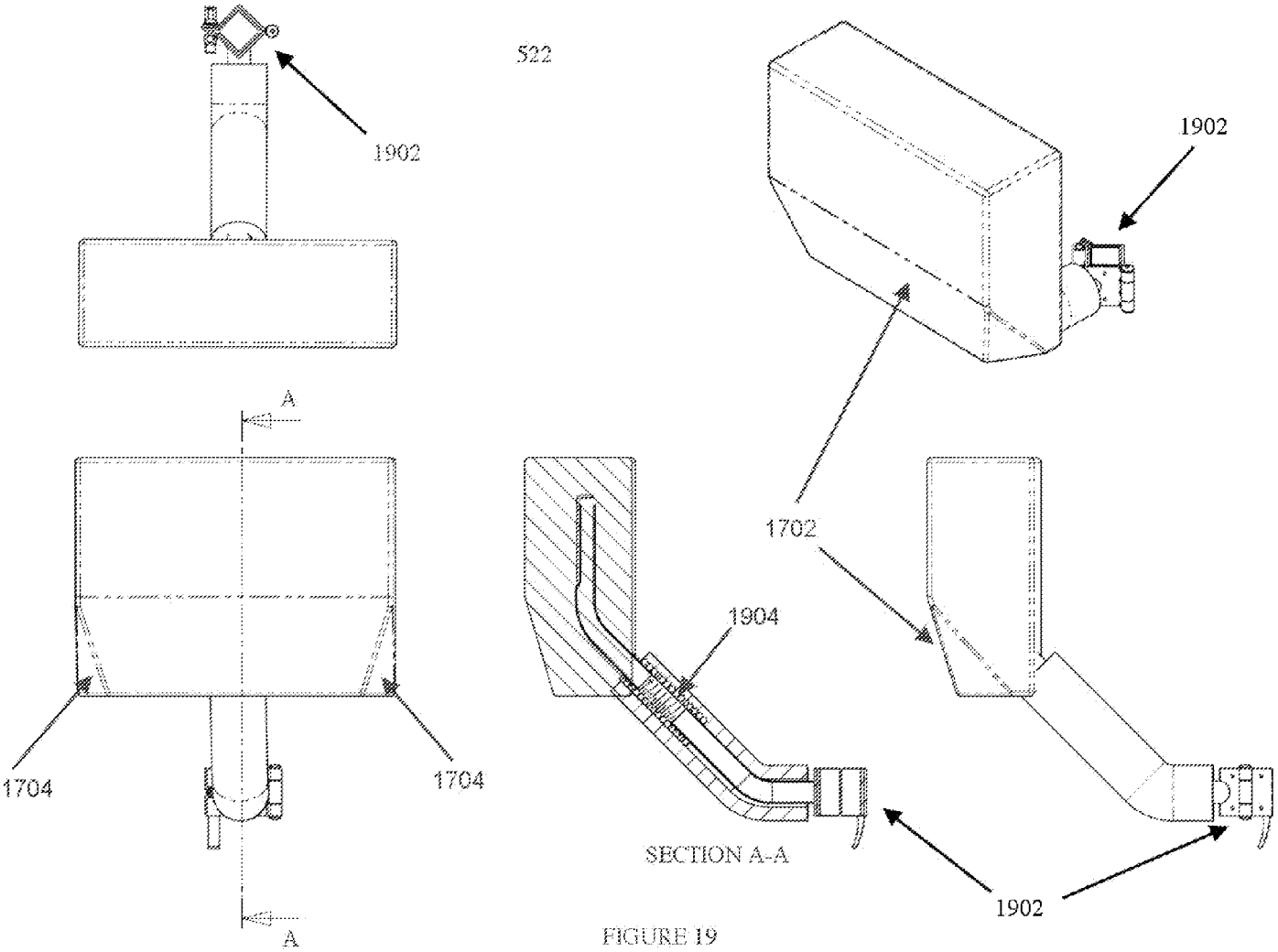
FIG. 19 illustrates various views of an embodiment of a torso target which may be positioned on the training stand of FIG. 1 or FIG. 9.
Figure 20:
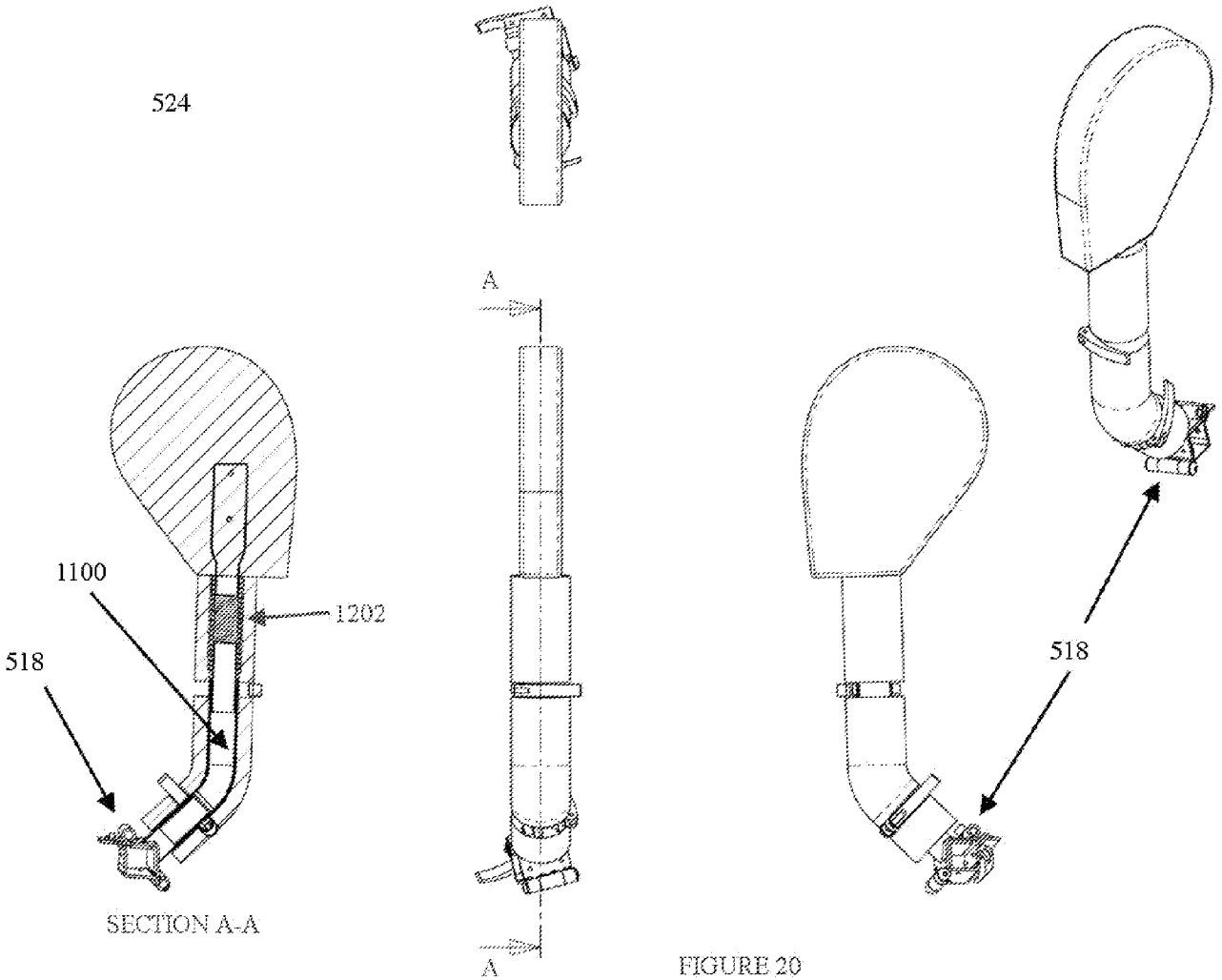
FIG. 20 illustrates various views of an embodiment of a hand target may be positioned on the training stand of FIG. 1 or FIG. 9.

The connector 518 may be removable from the pad as shown in the configuration in FIGS. 15, 16 and 20. Alternatively, the connector 518 may be permanently attached to one of the pads as shown in FIG. 18 item 1802 and in FIG. 19 item 1902. One advantage of attaching some pads permanently to a connector is to hold the pads securely in a preferred orientation. For example, head and torso pads may be held in the vertical orientation so they are permanently attached to the connectors. In some embodiments, the connectors allow for rotational movement about the training stand FIGS. 5 and 6 illustrate how different objects, i.e., striking pads or targets may be coupled to the training stand 100. A first target 520 may be in the form of a human head while a second target 522 may be in the form of a human torso. The shapes of first and second targets 520, 522 are shaped to allow upper cut punching thereto. Moreover, second target 522 may include angled corners, 1702 and 1704 i.e., at the bottom corners, to guide the user to use correct form. The optional T-Bar support 528 is shown attached to the telescoping piece 504 in a substantially horizontal orientation. Additional targets 524 and 526 mimic an attacker's arm and hand and are shown attached to the T-Bar support 528. Each pad or target 520 and 522 may be adjusted up or down along the length of the central support shaft 502 and telescoping piece 504. Each pad or target may be coupled to the central support shaft 502 and telescoping piece 504 using connectors 518, 1802 or 1902. Each pad or target 524 and 526 may be adjusted anywhere along the length of the T-Bar support 528 using connectors 518. Although the T-Bar support 528 is shown in a substantially horizontal orientation, the T-Bar support 528 may be adjusted in any vertical position or a 360 degrees orientation relative to the tube 1506 in the connector 518. This helps accommodate users of different heights as well as to simulate a person of different heights for whom the user wishes to defend himself or herself against.

Figure 1:
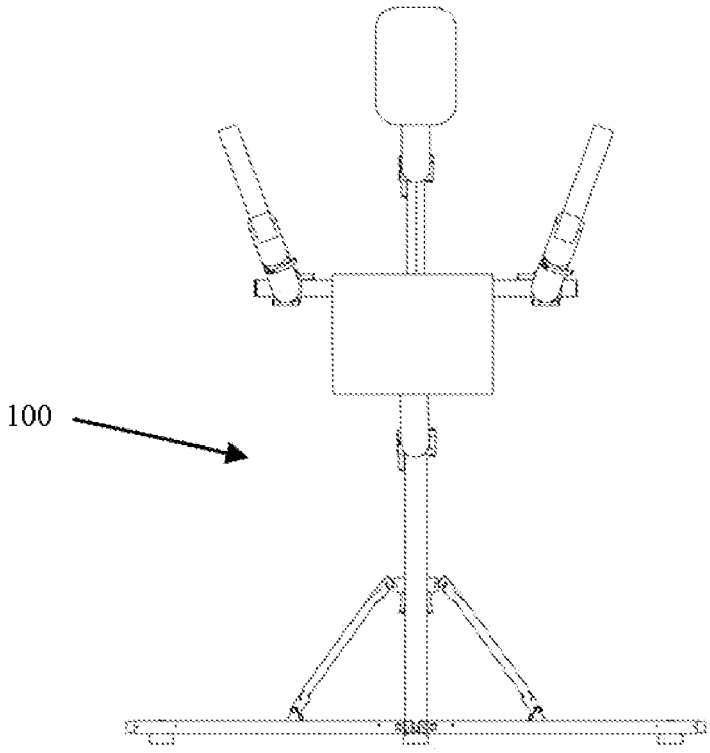
FIG. 1 illustrates a front view of a training stand according to an embodiment of the invention.
Figure 2:
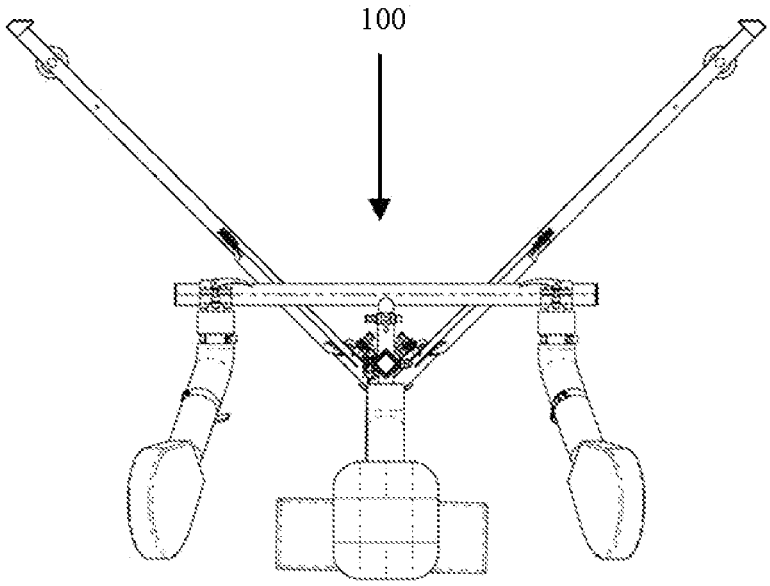
FIG. 2 illustrates a top view of the training stand of FIG. 1.
Figure 4:
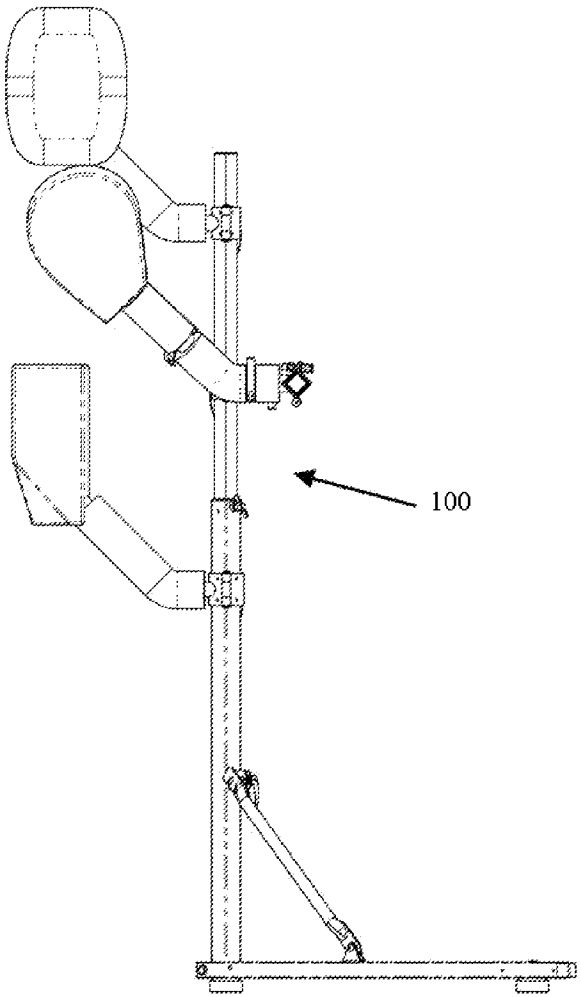
FIG. 4 illustrates a left side view of the training stand of FIG. 1.
Figure 3:
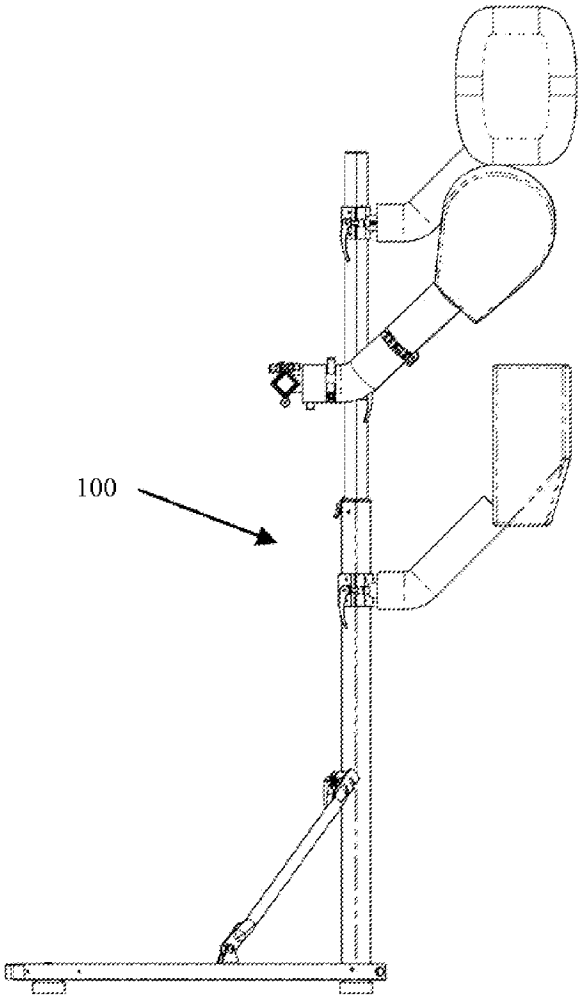
FIG. 3 illustrates a right side view of the training stand of FIG. 1.
Figure 21:
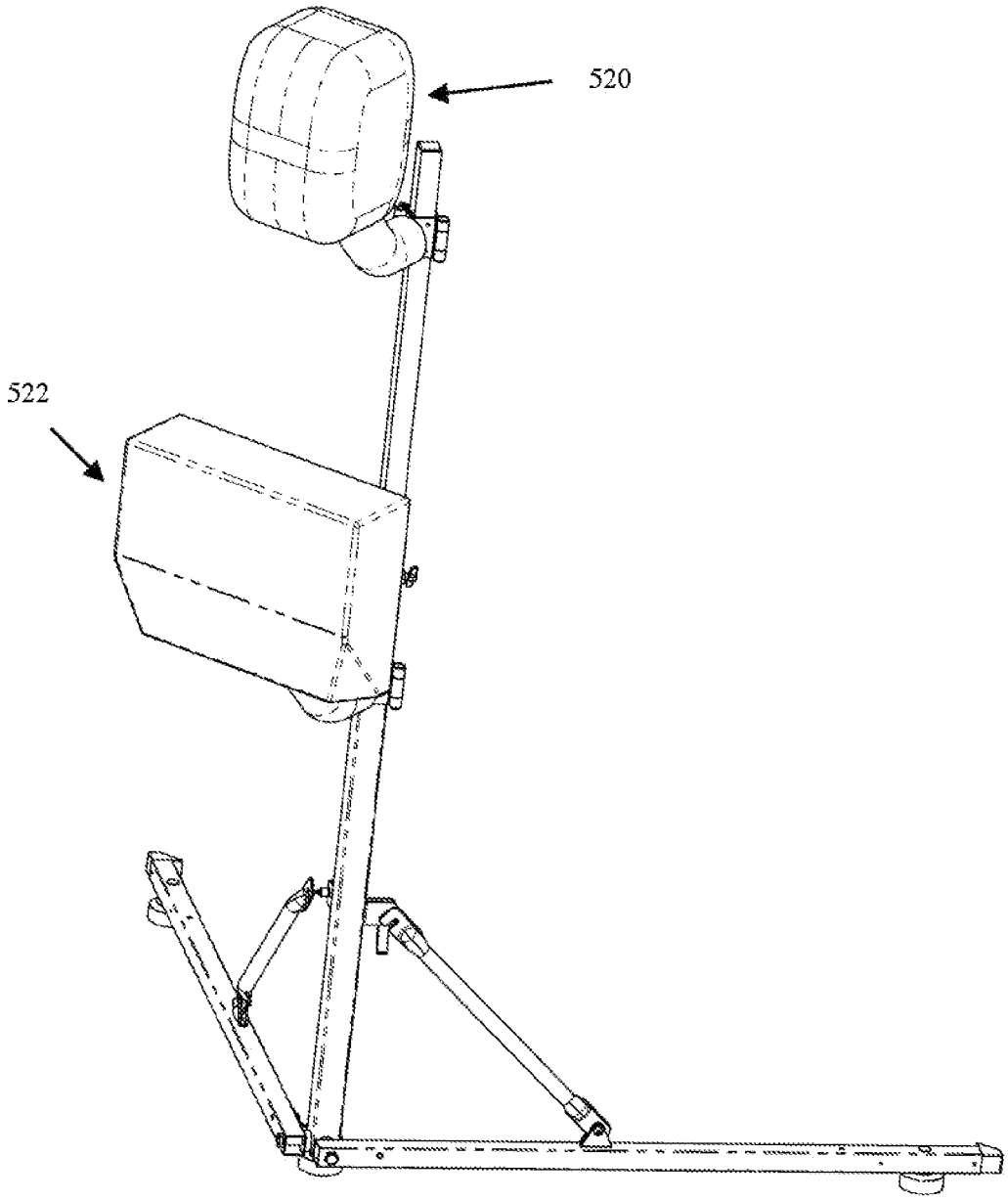
FIG. 21 illustrates a perspective view of another configuration the training stand of FIG. 1.

FIG. 21 illustrates a perspective view of another configuration the training stand of FIGS. 1 and 5. In this configuration the training stand includes just the first target 520 (head pad) and second target 522 (torso pad) while the remaining targets have been removed.

Figure 22:
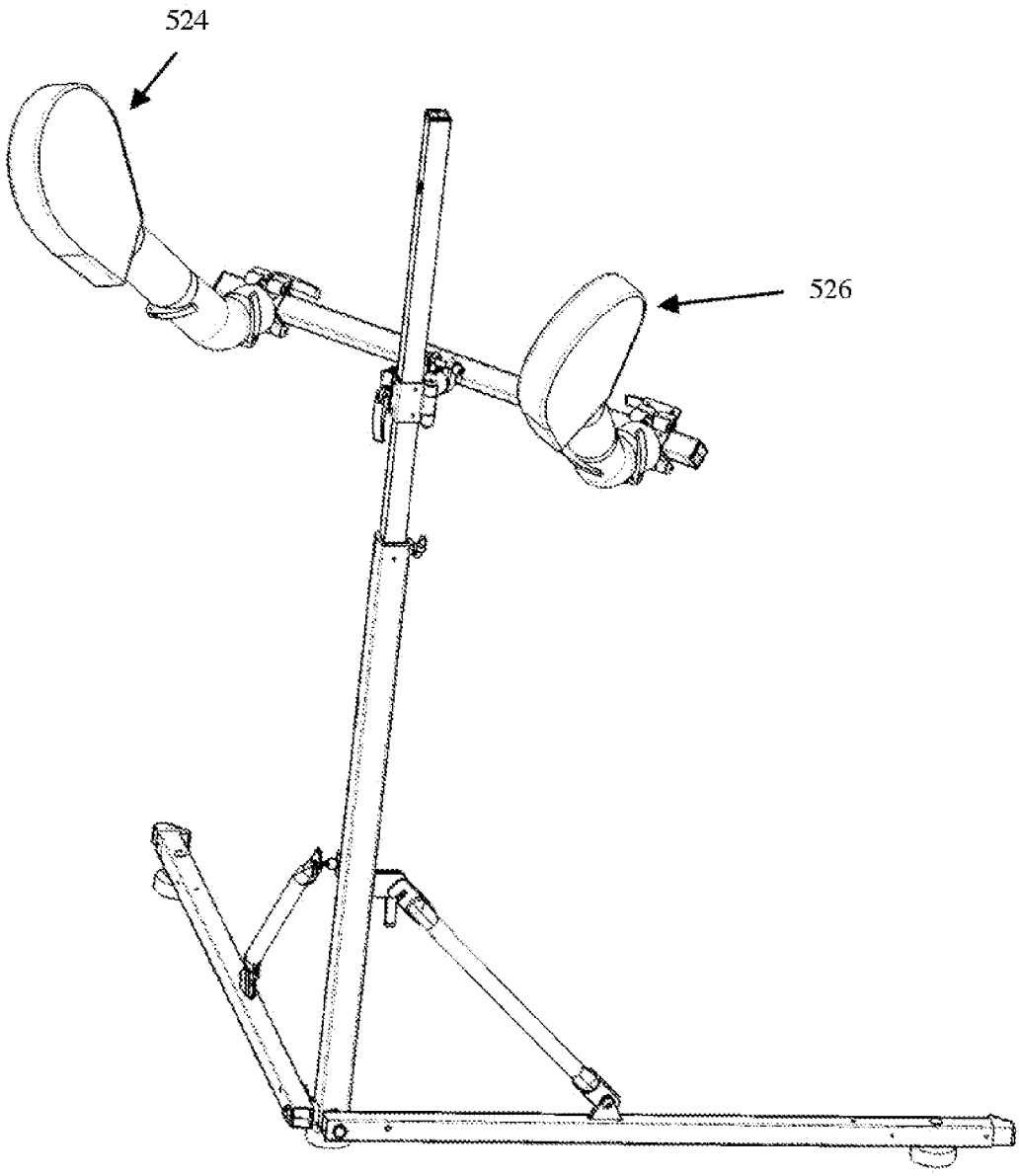
FIG. 22 illustrates a perspective view of yet another configuration the training stand of FIG. 1.

FIG. 22 illustrates a perspective view of yet another configuration the training stand of FIGS. 1 and 5. In this configuration the training stand includes just the pads 524 and 526 attached to the T-bar support while the remaining targets have been removed.

Figure 17:
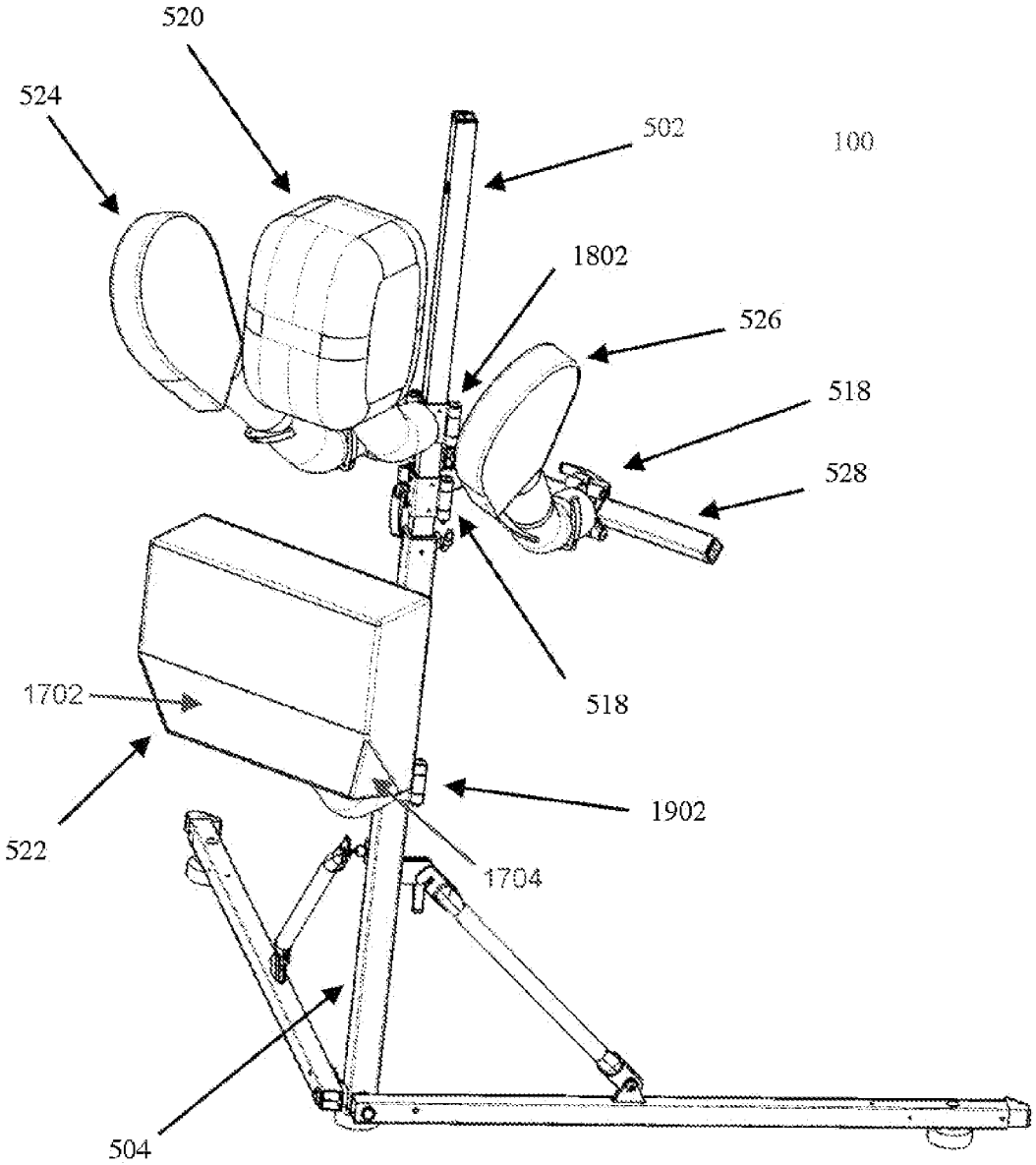
FIG. 17 illustrates a perspective view of the training stand of FIG. 1.

FIG. 17 illustrates how the same training pads and targets shown in FIG. 5 can be adjusted to simulate a smaller sized opponent. The human head shape target 520 and the human torso shape target 522 have been moved downward significantly along the central support shaft 502 and telescoping piece 504. The arm shaped targets 524 and 526 have moved significantly inward toward the central support shaft 502.

FIGS. 9, 10, 11, 12 and 13 illustrate the targets 524 and 526 in different positions attached to the training stand 100. The targets may be rotated into different orientations by adjusting the connectors 518 for practicing punching or kicking from any direction up, down, side to side or any angle in between. Between the connectors 518 and strike pads, the targets 520, 522, 524 and 526 may include a spring 1202, 1804 and 1904 such as a coil spring, or some other flexible material and/or component that can absorb or break the impact when the pads are struck.

Figure 11:
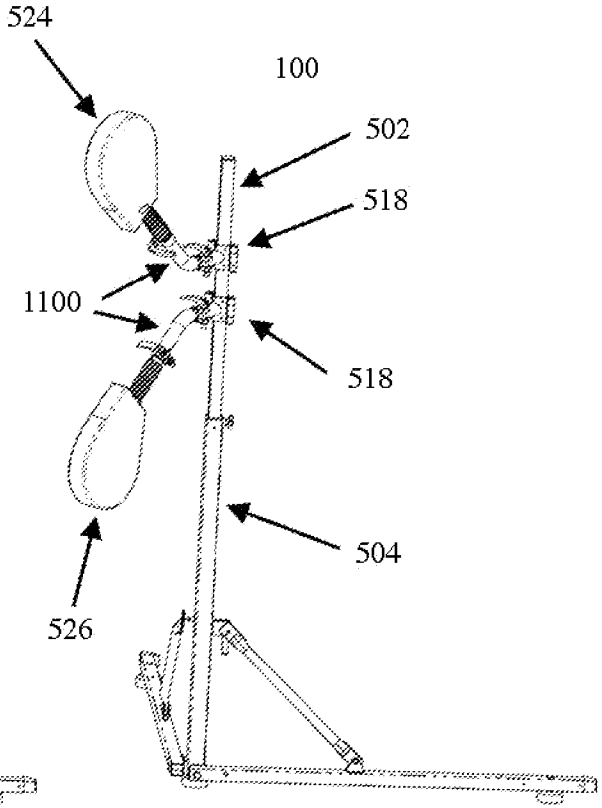
FIG. 11 illustrates the training stand of FIG. 9 with at least two targets positioned in yet another alternative position thereon.
Figure 10:
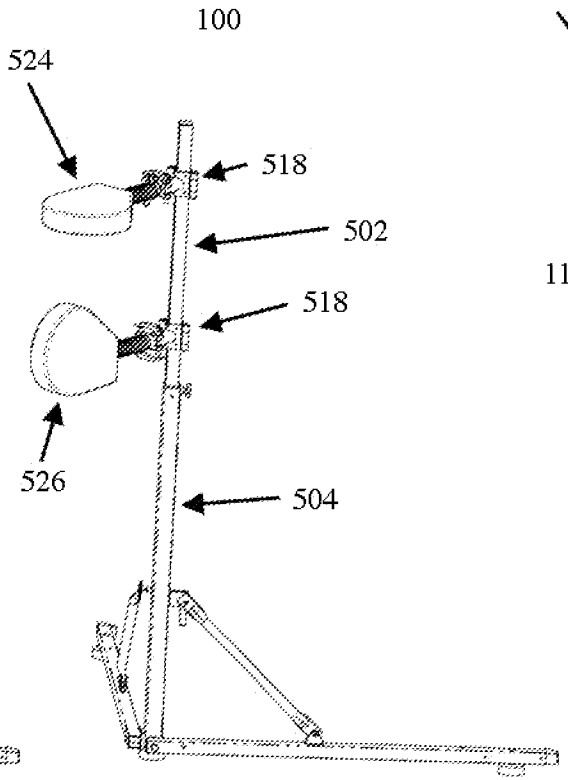
FIG. 10 illustrates the training stand of FIG. 9 with at least two targets positioned in an alternative position thereon.
Figure 9:
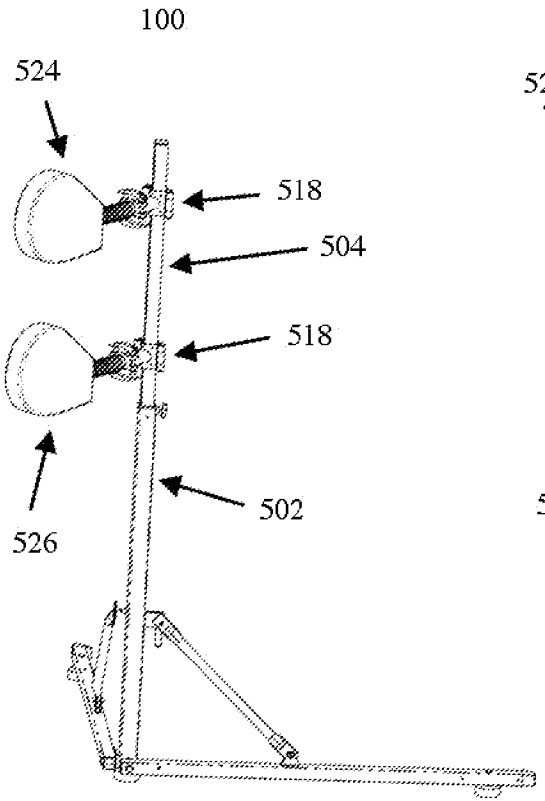
FIG. 9 illustrates a training standing according to another embodiment of the invention with at least two targets positioned thereon.
Figure 13:
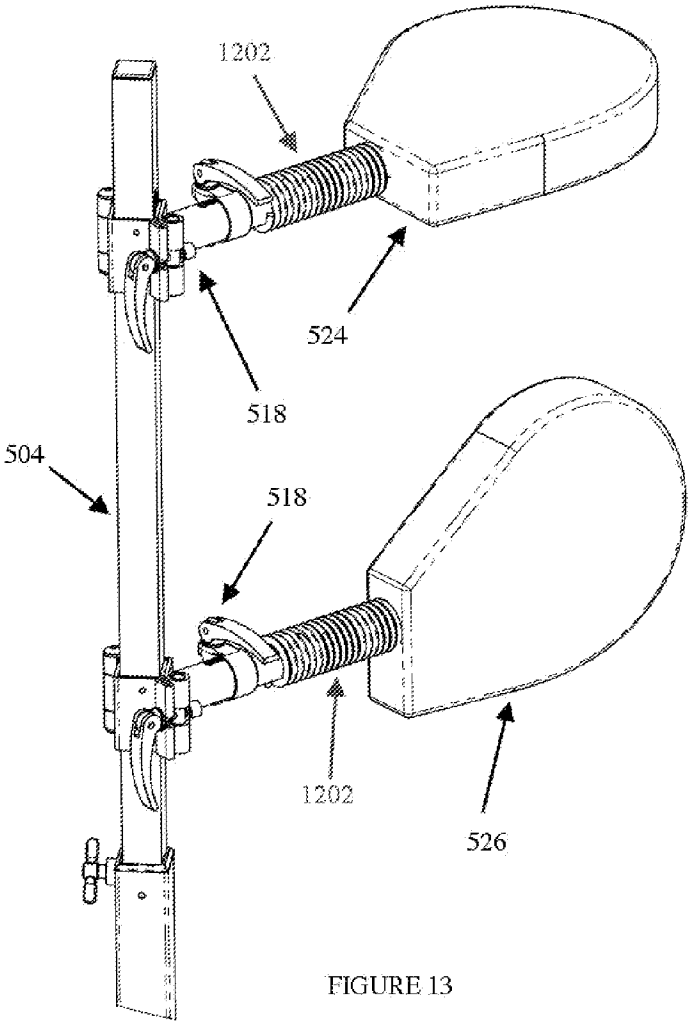
FIG. 13 illustrates a close-up view of at least two targets alternatively positioned on the training stand of FIG. 9.
Figure 12:
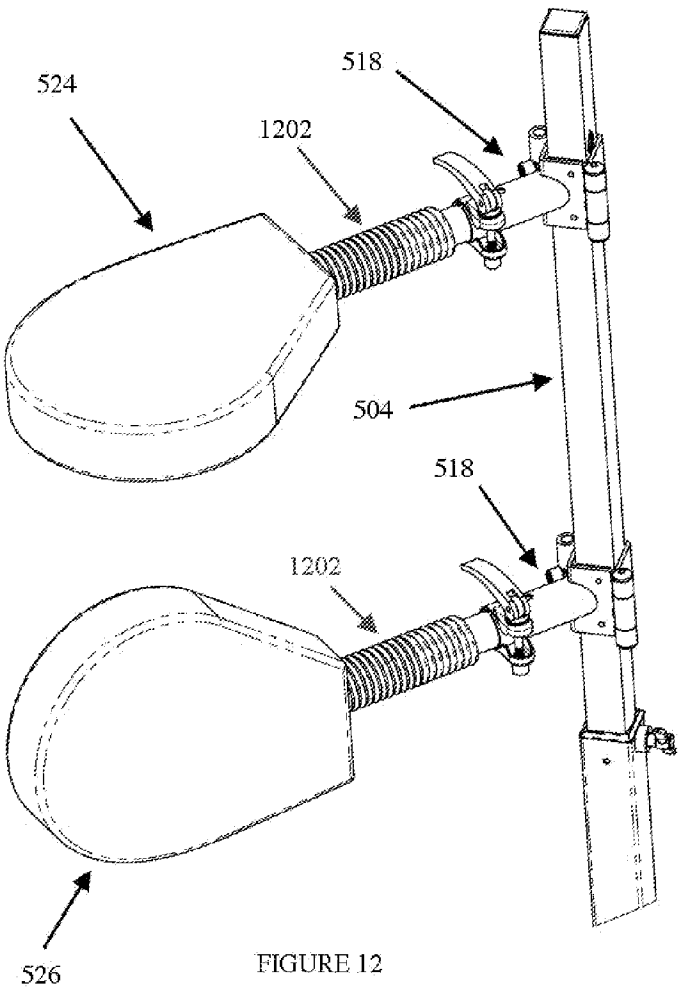
FIG. 12 illustrates a close-up view at least two targets positioned on the training stand of FIG. 9.

FIG. 11 illustrates optional extension attachments 1100 with angles which allow the targets 524 and 526 to have an additional degree of freedom of adjustability in their orientation. In one embodiment, the extension attachment 1100 is angled at less than 90 degrees. In another embodiment, the extension attachment 1100 is angled at about 135 degrees, although other embodiments may allow the angle of the extension attachment 1100 to be adjustable to other angles. The extension attachment 1100 may include a spring, such as a coil spring or some other flexible material that can absorb or break the impact when the targets are struck.

In some embodiments, there may be additional targets which attach to the training stand 100 using the same or different types of connectors. In other embodiments, there may be pads or targets in the shape of an arm, leg, hand or foot that attach to the training stand. Each of these may be adjusted along any position of the training stand.

In some embodiments, a fake gun or knife may be attached to the training stand 100, for example, to further practice self-defense techniques.

There may be additional type of targets that attach to the training stand that move on their own and actually simulate attacking the person who is training with the stand. This may be accomplished using electric motors or spring-loaded devices that release automatically or manually when the person training decides to release the moving attack targets. This movement may be regular or random.

FIG. 6 shows one implementation where weight bags (e.g., sand bags) 600 may be placed over the folding legs 506 and 508 to help keep the stand 100 in place when the pads or targets are struck. The use of small weight bags 600 allow for easily moving the training stand to a different location or putting it away for storage.

In alternative implementations, the training stand 100 may be kept in place by using weights that are normally used for weight lifting exercises.

In alternative implementations, the training stand can be permanently mounted to the ground using bolts or some other method, and the training stand still maintains the advantage of adjustability for users of many different sizes and training that simulates attackers of many different sizes.

In some implementations, parts of the support stand, e.g., central support shaft 502 and telescoping piece 504, may have additional padding to protect a user from accidentally hitting the stand 100.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A head-shaped target for a training stand comprising:

a striking target body shaped to approximate a human head and operative to receive strikes, the striking target body having a padded surface;

an attachment member configured to releasably couple the head-shaped target to a support shaft of the training stand; and an angled extension attachment coupling the striking target body to the attachment member, the angled extension attachment having a resilient spring positioned at an angle relative to the support shaft and the striking target body to enable the angled extension attachment to provide a resiliently deformable engagement between the striking target body and the support shaft, the resilient spring located between a bent portion of the angled extension attachment and a portion of the angled extension attachment that is coupled to the striking target body, wherein when the angled extension attachment is coupled to the support shaft by way of the attachment member, the angled extension attachment positions the striking target body to be horizontally offset from the support shaft.

2. The head-shaped target of claim 1, wherein the angled extension attachment couples at a rear and base of the striking target body to provide improved range of motion when the striking target body is struck.

3. The head-shaped target of claim 1, wherein the angled extension attachment has a bent point located between the resilient spring and another portion of the angled extension that is coupled to the attachment member.

4. The head-shaped target of claim 1, wherein the attachment member comprises a first quick release clamp that releasably couples the attachment member to the support shaft, the first quick release clamp provides an easy to actuate clamping mechanism.

5. The head-shaped target of claim 4, wherein the attachment member further comprises a second quick release clamp that releasably couples the attachment member to the angled extension attachment, the second quick release clamp provides an easy to actuate clamping mechanism.

6. The head-shaped target of claim 4, wherein the angled extension attachment is integral to the striking target body and the attachment member.

7. The head-shaped target of claim 1, wherein the padded surface of the striking target body substantially covers a top surface, a bottom surface, a front surface, a left side surface, and a right side surface of the striking target body.

8. The head-shaped target of claim 7, wherein the bottom surface of the striking target body is shaped and positioned to approximate a human chin, wherein the bottom surface is operative to receive uppercut punches and kicks.

9. A torso-shaped target for a training stand comprising:

a striking target body shaped to approximate a human torso and operative to receive strikes, the striking target body having a padded surface, wherein the striking body includes an angled bottom portion and angled bottom corners;

an attachment member configured to releasably couple the torso-shaped target to a support shaft of the training stand; and an angled extension attachment coupling the striking target body to the attachment member, the angled extension attachment having a resilient spring positioned at an angle relative to the support shaft and the striking target body to enable the angled extension attachment to provide a resiliently deformable engagement between the striking target body and the support shaft, the resilient spring located between a bent portion of the angled extension attachment and a portion of the angled extension attachment that is coupled to the striking target body, wherein when the angled extension attachment is coupled to the support shaft by way of the attachment member, the angled extension attachment positions the striking target body to be horizontally offset from the support shaft.

10. The torso-shaped target of claim 9, wherein the angled extension attachment couples at a rear and base of the striking target body to provide improved range of motion when the striking target body is struck.

11. The torso-shaped target of claim 10, wherein the angle is between 45 and 135 degrees.

12. The torso-shaped target of claim 9, wherein the attachment member comprises a first quick release clamp that releasably couples the attachment member to the support shaft, the first quick release clamp provides an easy to actuate clamping mechanism.

13. The torso-shaped target of claim 12, wherein the attachment member further comprises a second quick release clamp that releasably couples the attachment member to the angled extension attachment, the second quick release clamp provides an easy to actuate clamping mechanism.

14. The torso-shaped target of claim 12, wherein the angled extension attachment is integral to the striking target body and the attachment member.

15. The torso-shaped target of claim 9, wherein the padded surface of the striking target body substantially covers a top surface, a front surface, a left side surface, a right side surface, the angled bottom portion, and the angled bottom corners of the striking target body.

16. The torso-shaped target of claim 9, wherein the angled bottom portion and the angled bottom corners of the striking target body are shaped and positioned to approximate a portion of a human torso below the ribs, the angled bottom portion and the angled bottom corners configured to guide a user to use correct striking form.

17. A hand-shaped target for a training stand comprising:

a striking target body shaped and positioned to approximate a hand of a human and operative to receive strikes, the striking target body having a padded surface;

an attachment member configured to releasably couple the hand-shaped target to a T-bar support shaft of the training stand; and an angled extension attachment coupling the striking target body to the attachment member, the angled extension attachment having a resilient spring positioned at an angle relative to the support shaft and the striking target body to enable the angled extension attachment to provide a resiliently deformable engagement between the striking target body and the T-bar support shaft, the resilient spring located between a bent portion of the angled extension attachment and a portion of the angled extension attachment that is coupled to the striking target body, wherein when the angled extension attachment is coupled to the support shaft by way of the attachment member, the angled extension attachment positions the striking target body to be horizontally offset from the support shaft.

18. The hand-shaped target of claim 17, wherein the angled extension attachment couples at a rear of the striking target body to provide improved range of motion when the striking target body is struck.

19. The hand-shaped target of claim 18, wherein the angle is between 45 and 135 degrees.

20. The hand-shaped target of claim 19, wherein the attachment member comprises a first quick release clamp that releasably couples the attachment member to the T-bar support shaft, the first quick release clamp provides an easy to actuate clamping mechanism.

* * * * *